US008556644B1

(12) United States Patent
Yu et al.

(10) Patent No.: US 8,556,644 B1
(45) Date of Patent: Oct. 15, 2013

(54) ELECTRONIC DEVICE

(71) Applicant: Wistron Corporation, New Taipei (TW)

(72) Inventors: Ching-Jeng Yu, New Taipei (TW); Hsin-Wan Chen, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 0 days.

(21) Appl. No.: 13/923,358

(22) Filed: Jun. 20, 2013

Related U.S. Application Data

(62) Division of application No. 13/281,450, filed on Oct. 26, 2011, now Pat. No. 8,491,325.

(30) Foreign Application Priority Data

Aug. 30, 2011 (TW) ..... 100131071 A

(51) Int. Cl.
*H01R 12/71* (2011.01)

(52) U.S. Cl.
USPC ..... 439/260

(58) Field of Classification Search
USPC ..... 439/55, 67, 260, 263, 345, 492, 495
See application file for complete search history.

(56) References Cited

U.S. PATENT DOCUMENTS

| | | | |
|---|---|---|---|
| 4,630,874 | A | 12/1986 | Renn |
| 4,640,562 | A | 2/1987 | Shoemaker |
| 4,740,867 | A | 4/1988 | Roberts |
| 4,915,650 | A | 4/1990 | Daly |
| 5,007,858 | A | 4/1991 | Daly |
| 5,306,160 | A | 4/1994 | Roberts |
| 5,387,125 | A | 2/1995 | Davis |
| 6,319,033 | B1 | 11/2001 | Ma |
| 6,475,027 | B1 | 11/2002 | Boldt |
| 6,492,595 | B2 | 12/2002 | Sexton |
| 6,773,288 | B2 | 8/2004 | Geltsch |
| 7,112,079 | B2 | 9/2006 | Miura |
| 7,144,256 | B2 | 12/2006 | Pabst |
| 7,301,104 | B2 | 11/2007 | Miura |

(Continued)

FOREIGN PATENT DOCUMENTS

CN 101529661 A 9/2009

OTHER PUBLICATIONS

Office action mailed on Jun. 28, 2013 for the Taiwan application No. 100131071, filing date: Aug. 30, 2011, p. 1 line 14, p. 2-4, p. 5 line 4-5 and search report.

*Primary Examiner* — Alexander Gilman
(74) *Attorney, Agent, or Firm* — Winston Hsu; Scott Margo

(57) ABSTRACT

An electronic device includes a circuit board and a connector. The connector includes a first body, and a second body movably disposed on the first body. The first body includes a first plate, and a second plate connected to the first plate. The second body is located between the first plate and the second plate for clamping a reversible cable with the first body. The connector further includes a first connecting terminal disposed on the first body for contacting a first transmission terminal of the reversible cable, a second connecting terminal disposed on the second body for contacting a second transmission terminal of the reversible cable, a buckling structure disposed on the bodies, and a sheathing component. The sheathing component sheathes the first body and the second body for pressing the first body and the second body, to decrease a gap between the first body and the second body.

5 Claims, 8 Drawing Sheets

(56) References Cited

U.S. PATENT DOCUMENTS

| | | | | |
|---|---|---|---|---|
| 7,318,737 | B2 | 1/2008 | Yokoyama | |
| 7,344,399 | B2 | 3/2008 | Iijima | |
| 7,367,837 | B2 | 5/2008 | Pabst | |
| 7,399,192 | B2 | 7/2008 | Yamamoto | |
| 7,445,493 | B2 | 11/2008 | Takahira | |
| 7,455,531 | B2 | 11/2008 | Hirabayashi | |
| 7,637,763 | B1 | 12/2009 | Peng | |
| 7,648,386 | B2 | 1/2010 | Suzuki | |
| 7,722,398 | B2 | 5/2010 | Ma | |
| 7,871,281 | B2 | 1/2011 | Hemmi et al. | |
| 7,931,491 | B2 | 4/2011 | Takahashi | |
| 8,144,482 | B2 | 3/2012 | Sato | |
| 8,177,571 | B2 | 5/2012 | Yokoo | |
| 2002/0081883 | A1* | 6/2002 | Hotea et al. | 439/260 |
| 2002/0106924 | A1 | 8/2002 | Uehara | |
| 2006/0292910 | A1 | 12/2006 | Lee | |
| 2007/0178751 | A1 | 8/2007 | Yamamoto | |
| 2010/0087078 | A1* | 4/2010 | Hemmi et al. | 439/260 |
| 2012/0100736 | A1 | 4/2012 | Ashibu | |

* cited by examiner

ELECTRONIC DEVICE

CROSS REFERENCE TO RELATED APPLICATIONS

This is a division of U.S. patent application Ser. No. 13/281,450, filed Oct. 26, 2011.

BACKGROUND OF THE INVENTION

1. Field of the Invention

The present invention relates to an electronic device, and more particularly, to an electronic device with connector for clamping a reversible cable.

2. Description of the Prior Art

Generally, a conventional cable is a one-side cable, which means terminals are disposed on a single surface of the cable. A width of the one-side cable can be increased according to amounts and pitches of the terminals, for example, the width of the one-side cable having sixty terminals is two times the width of the one-side cable having thirty terminals. Thus, a connector for clamping the one-side cable on a circuit board has greater volume capable of completely covering the one-side cable having plenty terminals, and circuit arrangement space of the circuit board is decreased after the connector is disposed on the circuit board. Therefore, design of a connector having small volume for economizing disposition space of the circuit board is an important issue in the electronic industry.

SUMMARY OF THE INVENTION

The present invention provides an electronic device with connector for clamping a reversible cable for solving above drawbacks.

According to the claimed invention, an electronic device includes a circuit board, and a connector disposed on the circuit board for electrically connecting a reversible cable to the circuit board. The connector includes a first body. The first body includes a first plate and a second plate, the second plate is connected to the first plate in a relative curved manner. The connector further includes a second body movably disposed on the first body. The second body is located between the first plate and the second plate and for clamping a reversible cable with the first body. The connector further includes a first connecting terminal disposed on the first body for contacting a first transmission terminal of the reversible cable, a second connecting terminal disposed on the second body for contacting a second transmission terminal of the reversible cable, and a buckling structure. The buckling structure includes a first buckling portion disposed on the first body, and a second buckling portion disposed on the second body and clamped with the first buckling portion in a loose fit manner. The electronic device further includes a sheathing component sheathing the first body and the second body for pressing the first body and the second body, so as to decrease a gap between the first body and the second body. The connector is disposed on the circuit board via the first connecting terminal and the second connecting terminal. An end of the first connecting terminal protrudes from the first body along a direction of the second plate, and an end of the second connecting terminal protrudes from the second body along a direction parallel to the end of the first connecting terminal.

Structures of the connector of the present invention can be designed according to amounts and pitches of the transmission terminals of the reversible cable. The transmission terminals are respectively disposed on two lateral surfaces of the reversible cable for decreasing a width of the reversible cable. Accordingly, the connector designed for the reversible cable has characteristics of small volume and narrow width, so as to economize the circuit arrangement space of the circuit board effectively. The present invention includes a vertical type connector and a horizontal type connector, which respectively includes two movable bodies (the first body and the second body). In the embodiment of the vertical type connector, the second body can be closed to the first body by the constraining protrusion for clamping the reversible cable tightly. In the embodiment of the horizontal type connector, an assembly of the sheathing component and the interfering portion can be for driving the first body and the second body to tightly clamp the reversible cable. Therefore, the connector of the present invention has advantages of easy structure and convenient operation, and the reversible cable can be disposed on the circuit board in a perpendicular manner or in a parallel manner via the connector, so as to economize disposition space of the circuit board.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
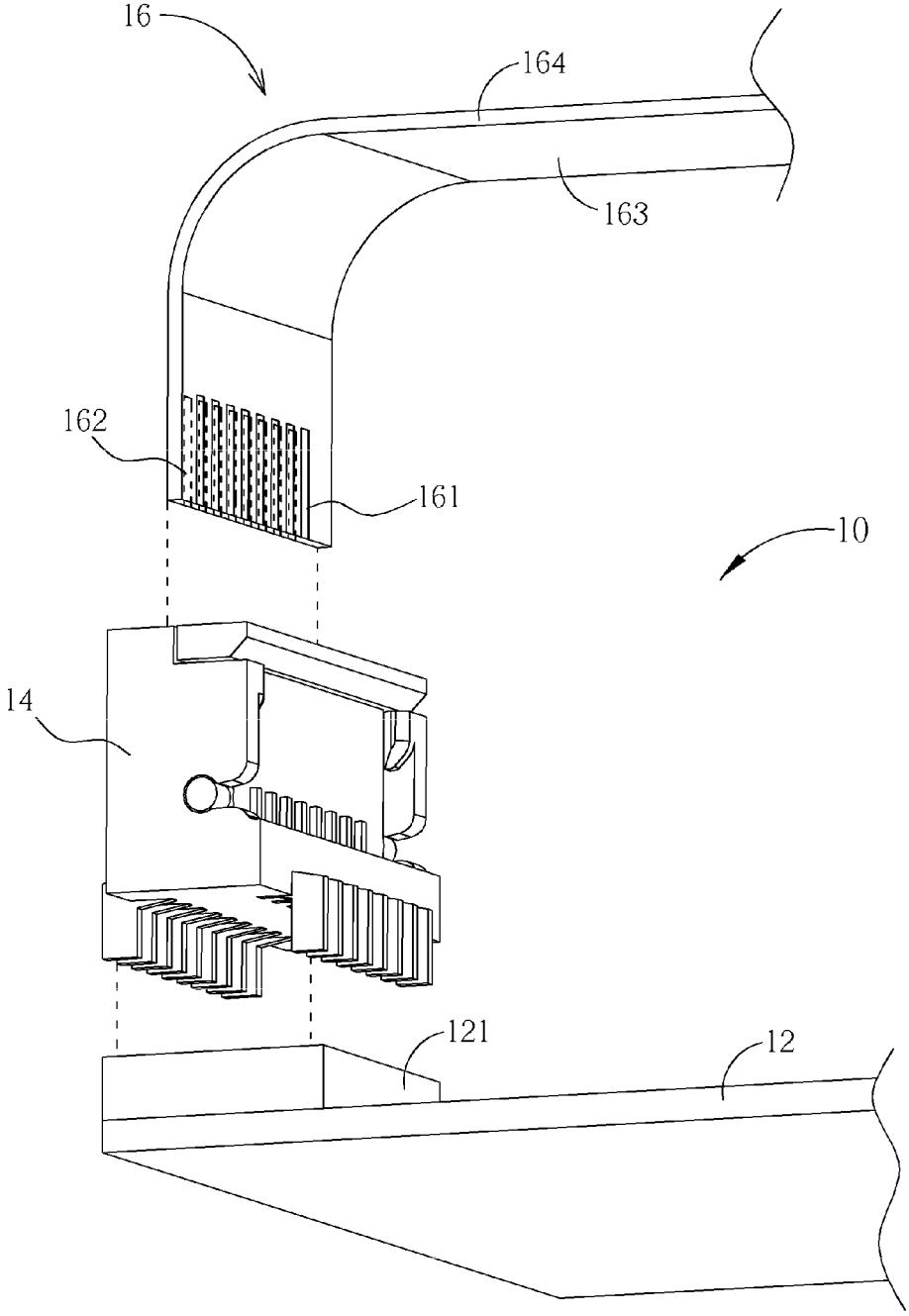
FIG. 1 is a diagram of an electronic device according to an embodiment of the present invention.

Please refer to FIG. 1. FIG. 1 is a diagram of an electronic device 10 according to an embodiment of the present invention. The electronic device 10 includes a circuit board 12 and a connector 14. The connector 14 is for clamping a reversible cable 16 (the two-side cable) and disposed on a socket 121 of the circuit board 12, so that the reversible cable 16 can be electrically connected to the circuit board 12 via the connector 14. The reversible cable 16 includes a first transmission terminal 161 and a second transmission terminal 162. The first transmission terminal 161 and the second transmission terminal 162 are respectively disposed on a first surface 163 and a second surface 164 of the reversible cable 16, and the first surface 163 and the second surface 164 are two opposite surfaces of the reversible cable 16. Thus, the connector 14 of the present invention can be for clamping the reversible cable 16 on the circuit board 12, so as to economize circuit arrangement space on the circuit board 12 effectively.

Figure 2:
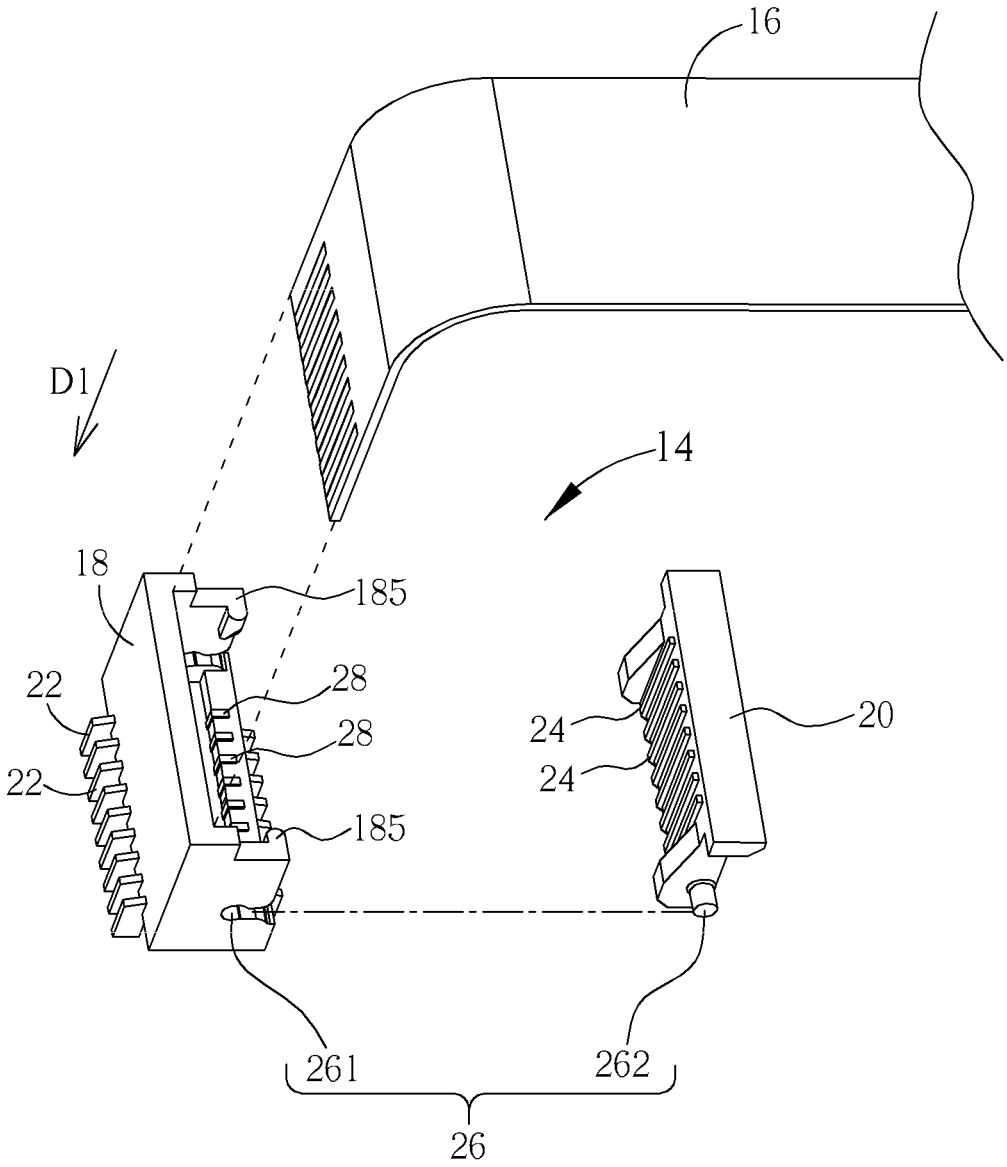
FIG. 2 and FIG. 3 are exploded diagrams of a connector in different views according to a first embodiment of the present invention.
Figure 3:
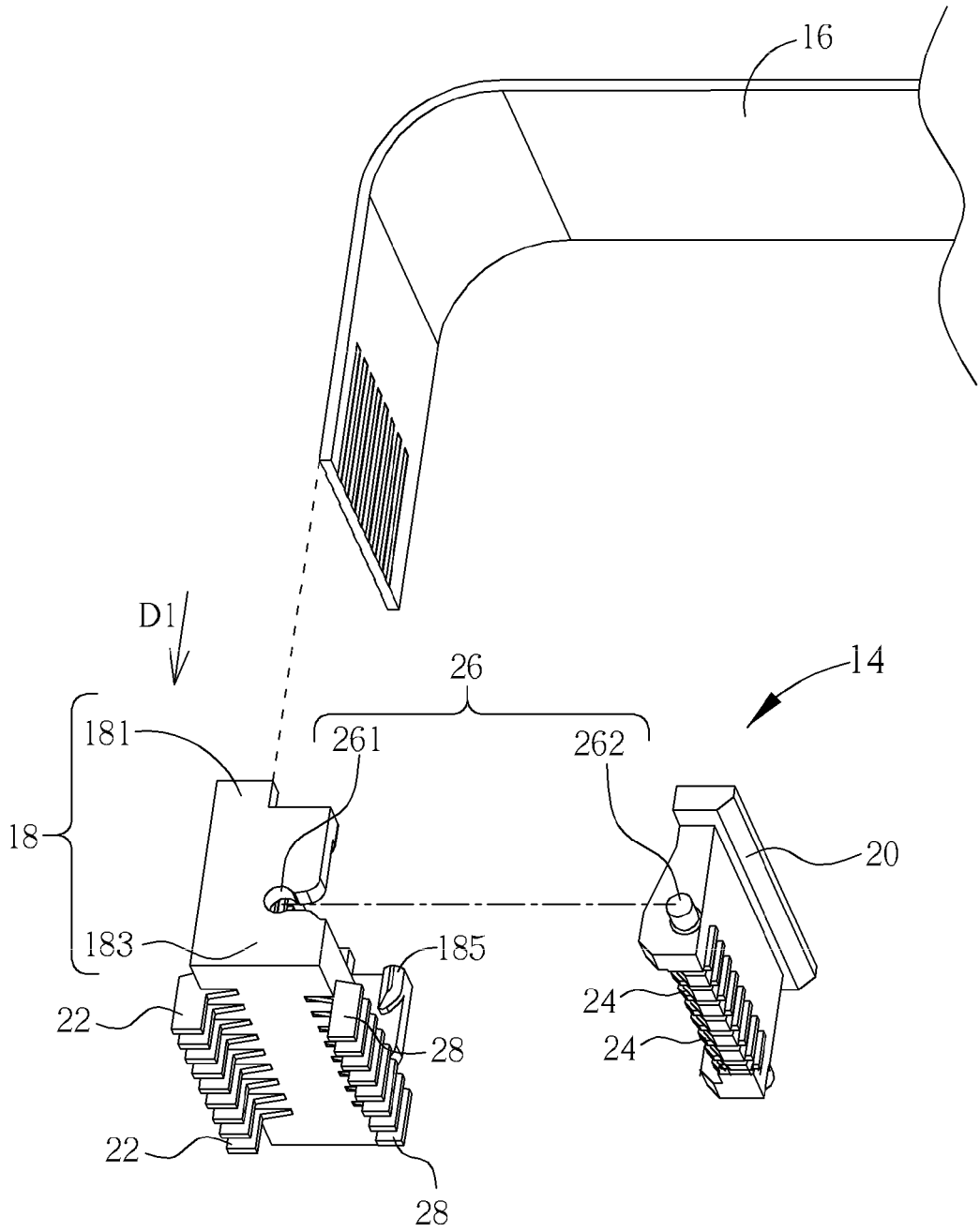
Figure 4:
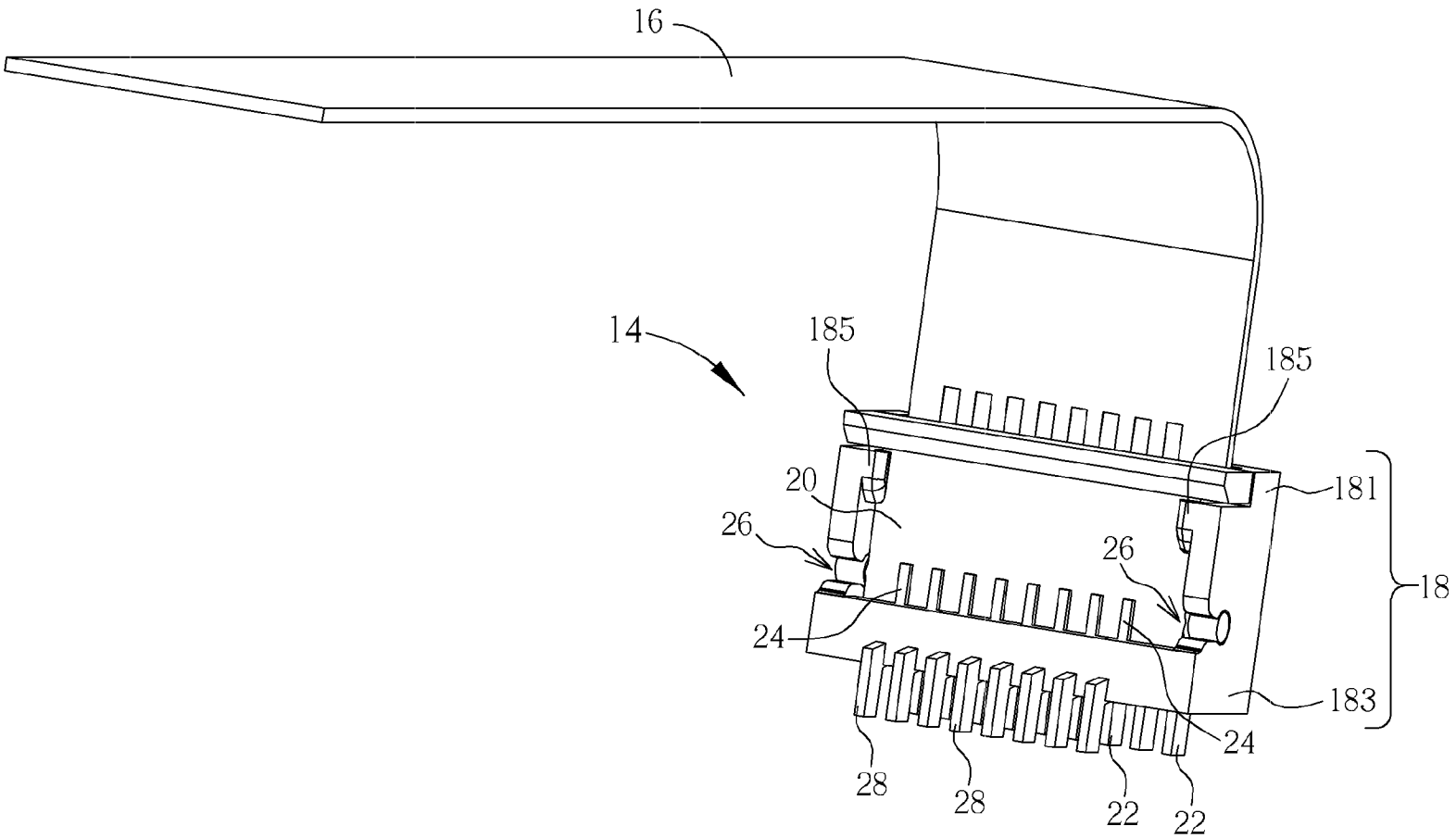
FIG. 4 is an assembly diagram of the connector according to the first embodiment of the present invention.

Please refer to FIG. 2 to FIG. 4. FIG. 2 and FIG. 3 are exploded diagrams of the connector 14 in different views according to a first embodiment of the present invention. FIG. 4 is an assembly diagram of the connector 14 according to the first embodiment of the present invention. The connector 14 includes a first body 18. The first body 18 includes a first plate 181 and a second plate 183, and the first plate 181 can be connected to the second plate 183 in a relative curved manner.

For example, the first body 18 of the connector 14 can be a L-shaped structure. The connector 14 further includes a second body 20 movably disposed on the first body 18. Because the first body 18 is the L-shaped structure, the second body 20 can be accommodated inside a sunken space of the L-shaped structure, which means the second body 20 can be located between the first plate 181 and the second plate 183, and the reversible cable 16 can insert into a gap between the first body 18 and the second body 20, so that the connector 14 can clamp the reversible cable 16 stably.

The connector 14 further includes a plurality of first connecting terminals 22 and a plurality of second connecting terminals 24 respectively disposed on the first body 18 and the second body 20. When the reversible cable 16 is clamped by the first body 18 and the second body 20, the first connecting terminals 22 and the second connecting terminals 24 can respectively contact the first transmission terminals 161 and the second transmission terminals 162 of the reversible cable 16 for electrically connection. In addition, the connector 14 can insert into the corresponding socket of the circuit board 12 via the first connecting terminal 22 and the second connecting terminal 24, so that the connector 14 can be stably disposed on the circuit board 12.

The connector 14 further includes two buckling structures 26 respectively disposed on two opposite sides of the connector 14. The buckling structure 26 includes a first buckling portion 261 disposed on the first body 18, and a second buckling portion 262 disposed on the second body 20. The second buckling portion 262 can be clamped with the first buckling portion 261 in a loose fit manner, which means the second buckling portion 262 can slightly move relative to the first buckling portion 261 when clamping with the first buckling portion 261. In the first embodiment, the first buckling portion 261 can be a pivoting hole, the second buckling portion 262 can be a pivoting shaft, and the pivoting shaft can be disposed inside the pivoting hole in a rotary manner. Therefore, the second body 20 of the connector 14 can pivot relative to the first body 18 by the buckling structures 26, so as to clamp the reversible cable 16 tightly.

It should be mentioned that an end of the first connecting terminal 22 can protrude from the first body 18 along a first direction D1 (the direction parallel to the first plate 181). The connector 14 can further include a plurality of third connecting terminals 28 disposed on the second plate 183 and protruding from the first body 18 along a direction parallel to the first connecting terminal 22 (which means the first direction D1). An end of the second connecting terminal 24 can protrude from the second body 20 and being for electrically connecting to the third connecting terminal 28 in a rotary manner. Thus, protruding direction of the connecting terminals of the connector 14 of the first embodiment can be substantially parallel to an inserting direction of the reversible cable 16, as shown in FIG. 2 to FIG. 4, which means that the reversible cable 16 can insert into the connector 14 along a direction perpendicular to the circuit board 12.

In addition, the first body 18 can further include two constraining protrusions 185 respectively disposed on two inner lateral surfaces of the first plate 181 adjacent to the second body 20 for clamping the second body 20. For example, when the second body 20 is away from the first body 18 (a direction of the second body 20 is substantially perpendicular to a direction of the first plate 181 of the first body 18), the second connecting terminal 24 of the second body 20 can not contact the third connecting terminal 28 of the first body 18. When the second body 20 clamps the reversible cable 16 with the first body 18 (the direction of the second body 20 is substantially parallel to the direction of the first plate 181 of the first body 18), the constraining protrusions 185 can be for clamping lateral sides of the second body 20, so as to prevent the second body 20 from separating from the first body 18, meanwhile, the second connecting terminal 24 of the second body 20 can contract the third connecting terminal 28 of the first body 18 for electrically connection.

Figure 5:
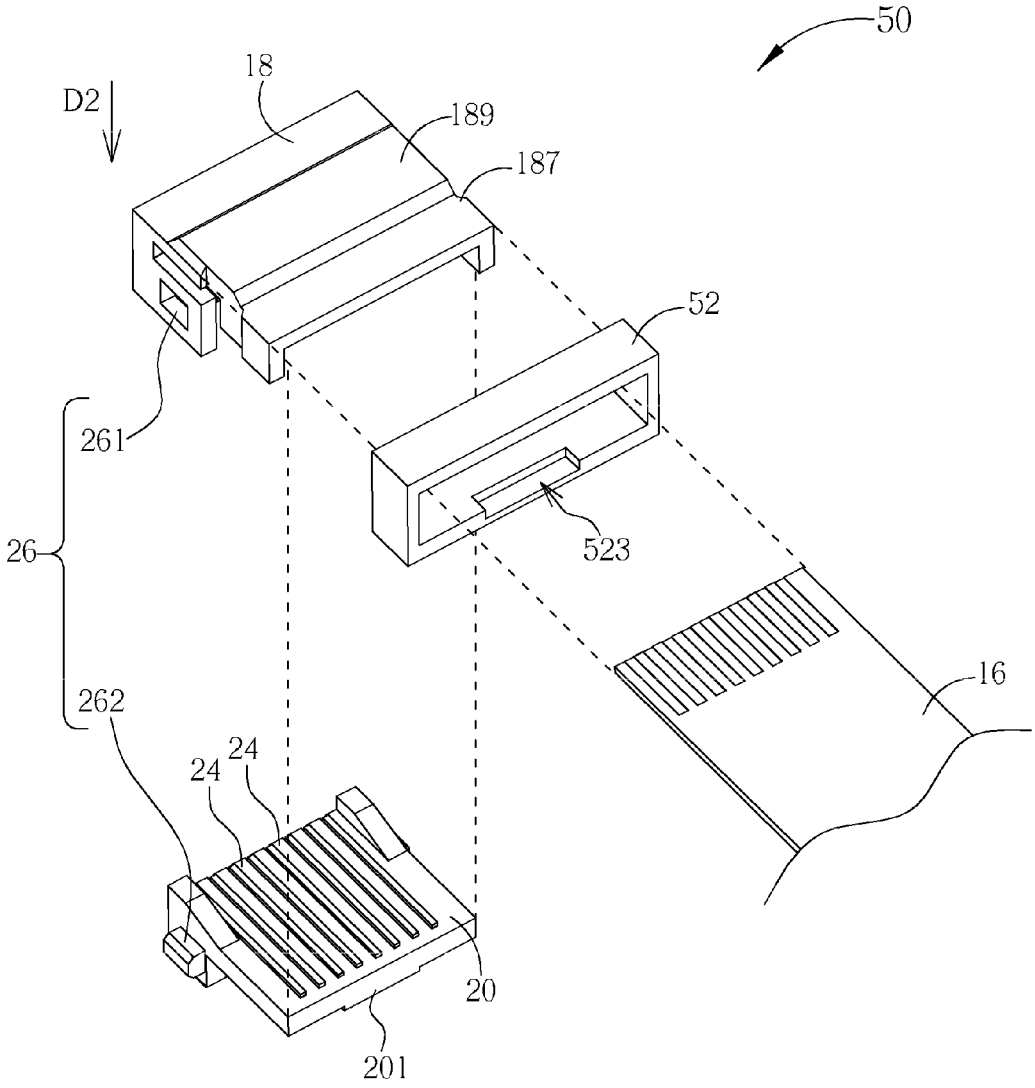
FIG. 5 to FIG. 7 are exploded diagrams of a connector in different views according to a second embodiment of the present invention.
Figure 6:
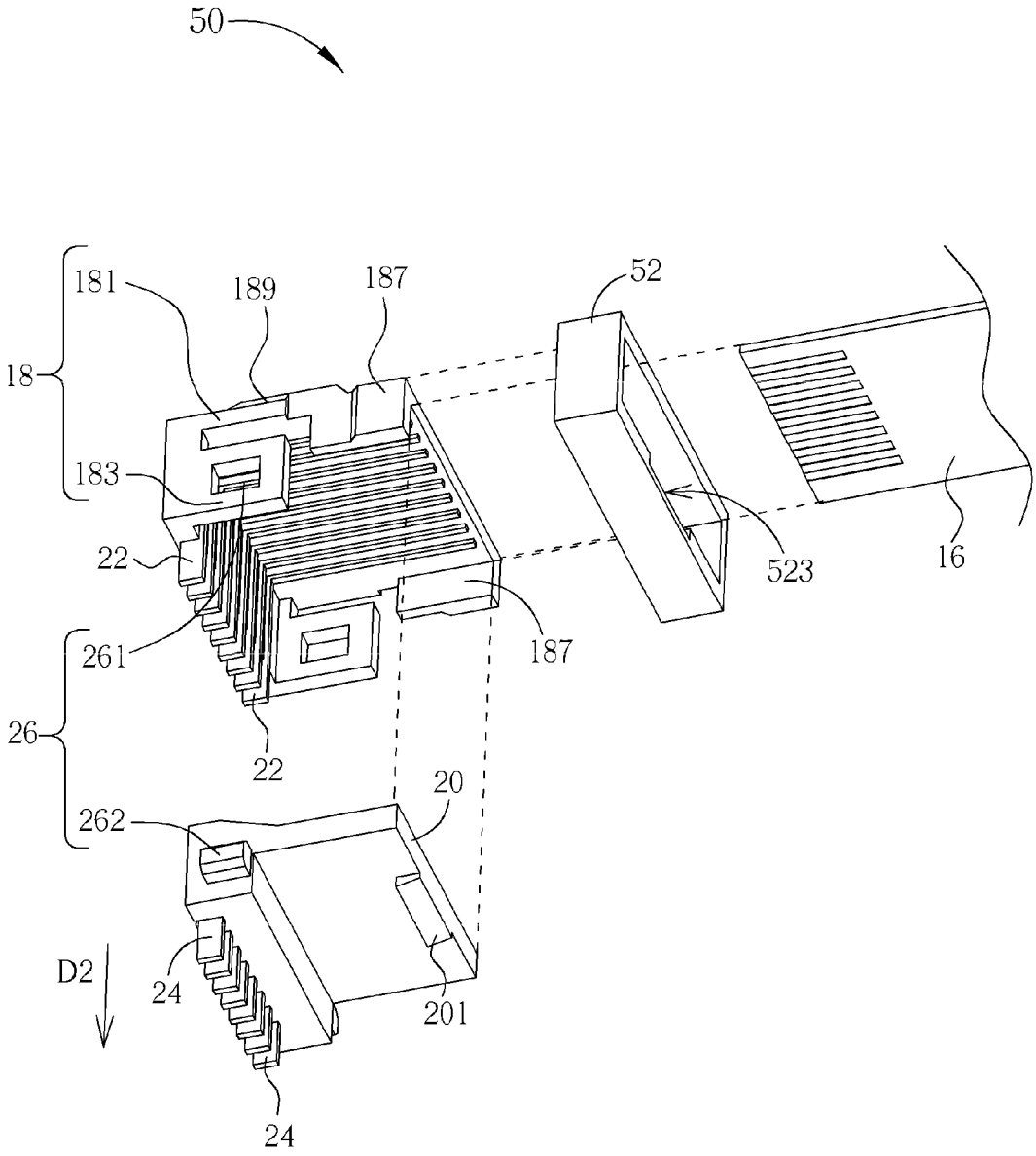
Figure 7:
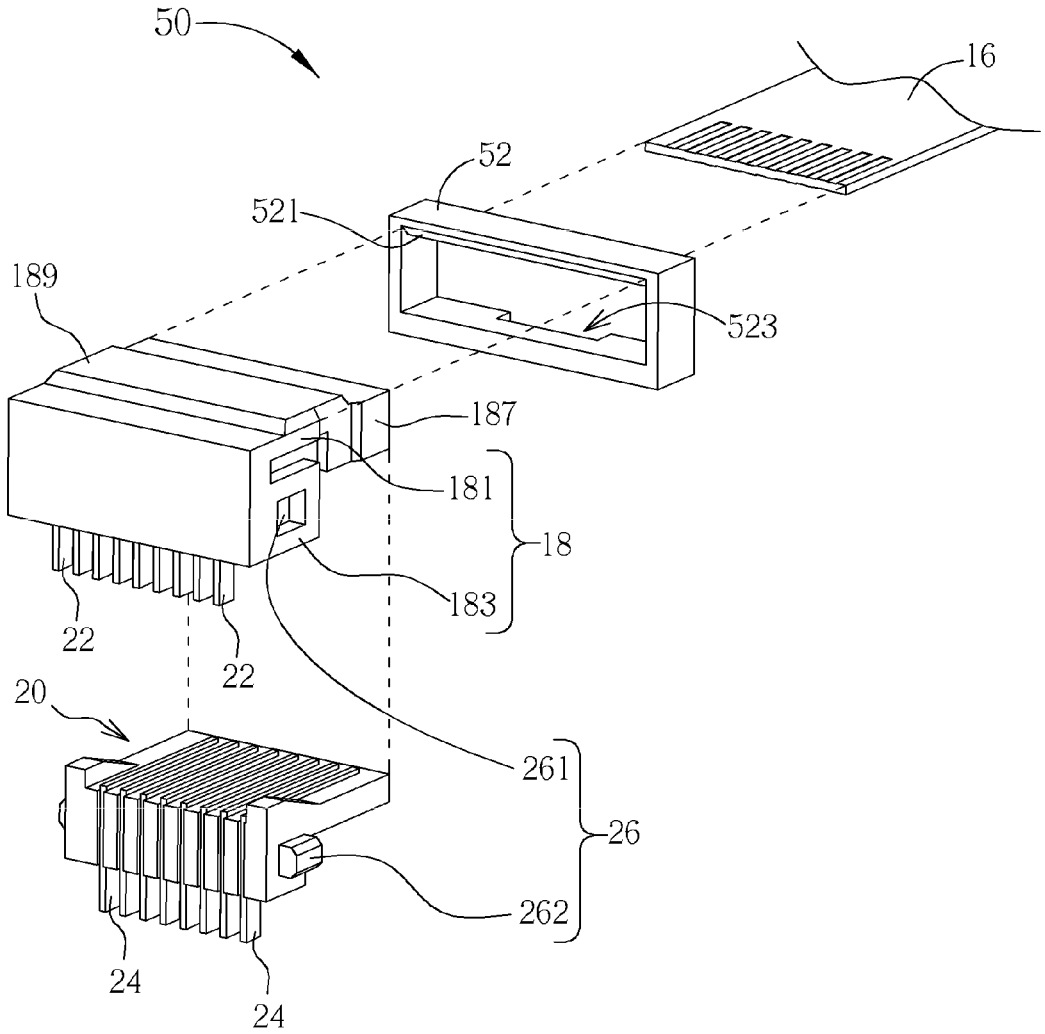
Figure 8:
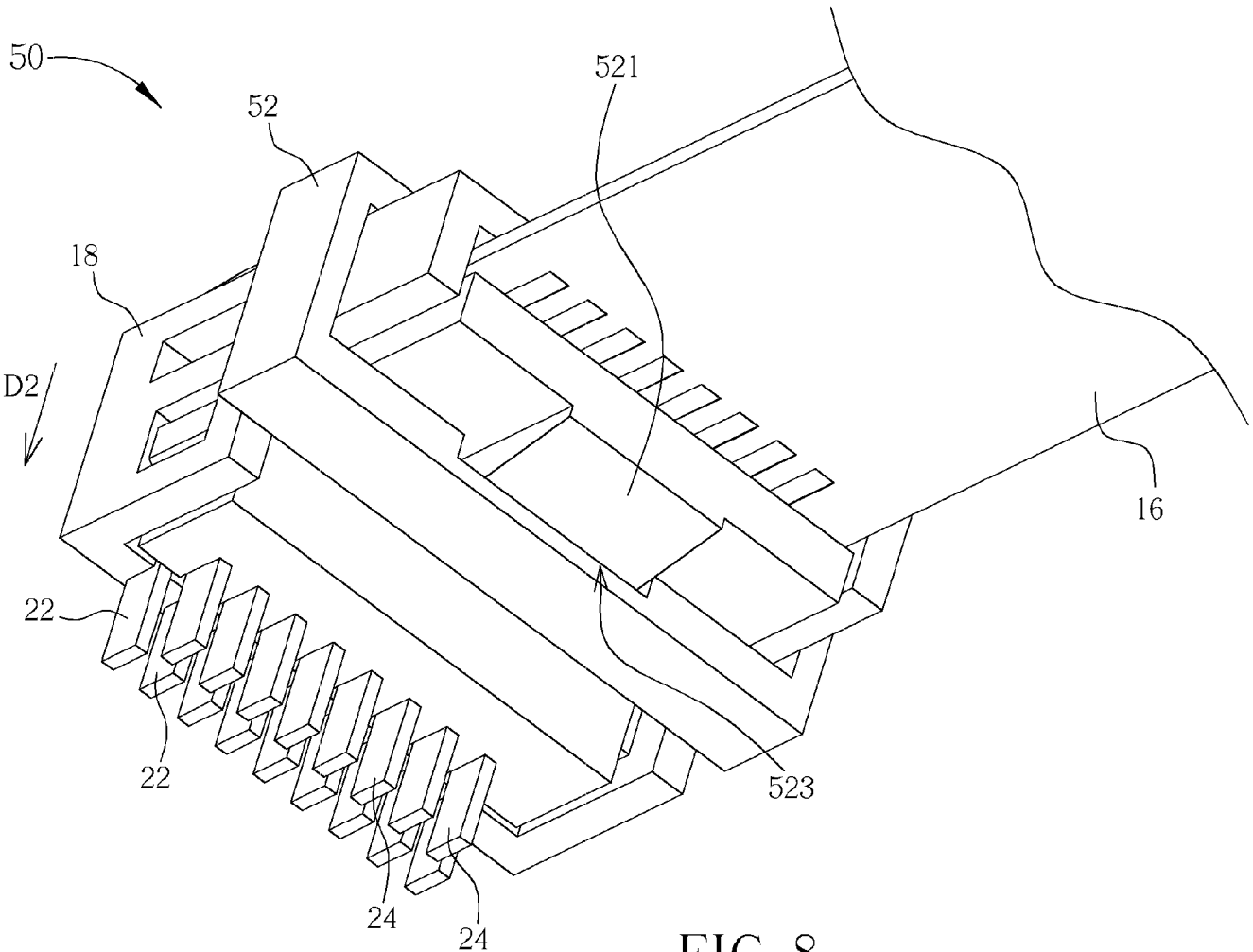
FIG. 8 is an assembly diagram of the connector according to the second embodiment of the present invention.

Please refer to FIG. 5 to FIG. 8. FIG. 5 to FIG. 7 are exploded diagrams of a connector 50 in different views according to a second embodiment of the present invention. FIG. 8 is an assembly diagram of the connector 50 according to the second embodiment of the present invention. In the second embodiment, elements having the same numerals as ones of the first embodiment have the same structures and functions, and detail description is omitted herein for simplicity. Difference between the first embodiment and the second embodiment is that an end of the first connecting terminal 22 of the connector 50 can protrude from the first body 18 along a second direction D2 (a direction parallel to the second plate 183), and an end of the second connecting terminal 24 can protrude from the second body 20 along the direction parallel to the first connecting terminal 22 (which means the second direction D2). Thus, protruding direction of the connecting terminals of the connector 50 of the second embodiment can be substantially perpendicular to an inserting direction of the reversible cable 16, as shown in FIG. 8, which means that the reversible cable 16 can insert into the connector 50 along a direction parallel to the circuit board 12.

In the second embodiment, the first buckling portion 261 of the connector 50 can be a ring, the second buckling portion 262 can be a protrusion, and the protrusion can be clamped with the ring in a loose fit manner. The reversible cable 16 can insert into a gap between the first body 18 and the second body 20. The connector 50 can further include a sheathing component 52 for sheathing the first body 18 and the second body 20. Because the protrusion (the second buckling portion 262) can be clamped with the ring (the first buckling portion 261) in the loose fit manner, and dimensions of the gap between the first body 18 and the second body 20 can be substantially greater than volume of the reversible cable 16, the sheathing component 52 of the second embodiment can be for pressing the first body 18 and the second body 20, so as to decrease the gap between the first body 18 and the second body 20 for tightly clamping the reversible cable 16.

Furthermore, a guiding portion 521, such as an inclined structure, can be disposed on a lateral side of the sheathing component 52 adjacent to the first body 18, as shown in FIG. 7. For installing the sheathing component 52 on the first body 18 and the second body 20, the guiding portion 521 can guide the first body 18 (or the second body 20, which corresponds to a position of the guiding portion 521) to smoothly insert into a space of the sheathing component 52. An engaging slot 523 can be further formed on a lateral side of the sheathing component 52 adjacent to the second body 20, and an engaging portion 201 can be disposed on a lateral surface of the second body 20 adjacent to the sheathing component 52. When the sheathing component 52 sheathes the first body 18 and the second body 20, the engaging portion 201 can be engaged inside the engaging slot 523 for preventing the sheathing component 52 from separating from the second body 20. The first body 18 can further include a contacting portion 187 disposed on a lateral surface of the first plate 181, and an interfering portion 189 disposed on an upper surface of the first plate 181. When the sheathing component 52 sheathes the first body 18 and the second body 20, the contacting portion 187 can contact against the sheathing component 52 for preventing the sheathing component 52 from separating from the first body 18 and the second body 20 along a direction opposite to the sheathing direction. The interfering portion 189 can be for increasing a thickness of the first body 18. Thus, the gap between the first body 18 and the second body 20 can be decreased by interference of the interfering portion 189 and the sheathing component 52 when the sheathing component 52 sheathes the first body 18 and the second body 20 and covers the interfering portion 189, so as to clamp the reversible cable 16 tightly.

Comparing to the prior art, structures of the connector of the present invention can be designed according to amounts and pitches of the transmission terminals of the reversible cable. The transmission terminals are respectively disposed on two lateral surfaces of the reversible cable for decreasing a width of the reversible cable. Accordingly, the connector designed for the reversible cable has characteristics of small volume and narrow width, so as to economize the circuit arrangement space of the circuit board effectively. The present invention includes a vertical type connector and a horizontal type connector, which respectively includes two movable bodies (the first body and the second body). In the embodiment of the vertical type connector, the second body can be closed to the first body by the constraining protrusion for clamping the reversible cable tightly. In the embodiment of the horizontal type connector, an assembly of the sheathing component and the interfering portion can be for driving the first body and the second body to tightly clamp the reversible cable. Therefore, the connector of the present invention has advantages of easy structure and convenient operation, and the reversible cable can be disposed on the circuit board in a perpendicular manner or in a parallel manner via the connector, so as to economize disposition space of the circuit board.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic device comprising:

a circuit board; and a connector disposed on the circuit board for electrically connecting a reversible cable to the circuit board, the connector comprising:

a first body comprising a first plate and a second plate, the second plate being connected to the first plate in a non-parallel manner;

a second body movably disposed on the first body, the second body being located by sides of the first plate and the second plate and for clamping the reversible cable with the first plate of the first body;

a first connecting terminal disposed on the first body for contacting a first transmission terminal of the reversible cable;

a second connecting terminal disposed on the second body for contacting a second transmission terminal of the reversible cable; and a buckling structure comprising:

a first buckling portion disposed on the first body; and a second buckling portion disposed on the second body and clamped with the first buckling portion in a loose fit manner;

a sheathing component sheathing the first body and the second body for pressing the first body and the second body, so as to decrease a gap between the first body and the second body;

wherein the connector is disposed on the circuit board via the first connecting terminal and the second connecting terminal, an end of the first connecting terminal protrudes from the first body along a direction of the second plate, and an end of the second connecting terminal protrudes from the second body along a direction parallel to the end of the first connecting terminal.

2. The electronic device of claim 1, wherein a guiding portion is disposed on a lateral side of the sheathing component adjacent to the first body.

3. The electronic device of claim 1, wherein an engaging slot is formed on a lateral side of the sheathing component adjacent to the second body, an engaging portion is disposed on a lateral surface of the second body adjacent to the sheathing component, and the engaging portion is for engaging with the engaging slot.

4. The electronic device of claim 1, wherein the first body further comprises a contacting portion disposed on a lateral surface of the first plate for contacting against the sheathing component.

5. The electronic device of claim 1, wherein the first body further comprises an interfering portion disposed on an upper surface of the first plate for interfering with the sheathing component, so as to decrease the gap between the first body and the second body.

* * * * *